US008448393B2

(12) United States Patent
Voegele, Jr. et al.

(10) Patent No.: US 8,448,393 B2
(45) Date of Patent: May 28, 2013

(54) LARGE-AREA SKYLIGHT SYSTEM

(75) Inventors: William P. Voegele, Jr., Pittsburgh, PA (US); Kevin P. Smith, Glenshaw, PA (US)

(73) Assignee: Extech/Exterior Technologies, Inc., Pittsburgh, PA (US)

( * ) Notice: Subject to any disclaimer, the term of this patent is extended or adjusted under 35 U.S.C. 154(b) by 224 days.

(21) Appl. No.: 13/098,507

(22) Filed: May 2, 2011

(65) Prior Publication Data

US 2012/0240491 A1 Sep. 27, 2012

Related U.S. Application Data

(60) Provisional application No. 61/467,536, filed on Mar. 25, 2011.

(51) Int. Cl.
*E04D 13/03* (2006.01)

(52) U.S. Cl.
USPC ..... 52/200

(58) Field of Classification Search
USPC ..... 52/200
See application file for complete search history.

(56) References Cited

U.S. PATENT DOCUMENTS 3,434,250 A * 3/1969 Kiekhaefer ..... 52/22
4,409,767 A * 10/1983 Jentoft et al. ..... 52/200
4,449,340 A * 5/1984 Jentoft et al. ..... 52/200
4,455,799 A * 6/1984 Jentoft et al. ..... 52/200
4,514,943 A 5/1985 Jentoft et al.
4,549,379 A 10/1985 Hoy et al.
4,559,753 A 12/1985 Brueske
4,570,394 A * 2/1986 Jentoft et al. ..... 52/72
4,649,680 A 3/1987 Weisner
4,757,655 A 7/1988 Jentoft
RE32,915 E * 5/1989 Jentoft et al. ..... 52/200
4,862,657 A * 9/1989 Jentoft et al. ..... 52/200
4,930,275 A * 6/1990 Verby et al. ..... 52/200
4,941,300 A * 7/1990 Lyons, Jr. ..... 52/58
4,972,638 A * 11/1990 Minter ..... 52/200
5,044,133 A 9/1991 Sampson
5,148,647 A * 9/1992 Rutledge ..... 52/302.1
5,216,855 A * 6/1993 Richter et al. ..... 52/200
5,355,644 A * 10/1994 Guhl et al. ..... 52/200
5,544,455 A * 8/1996 DeBlock ..... 52/200
5,553,425 A * 9/1996 Sampson et al. ..... 52/58
5,669,186 A * 9/1997 Verby et al. ..... 52/72
5,913,785 A 6/1999 Moller
5,960,596 A * 10/1999 Lyons, Sr. ..... 52/200
6,052,956 A 4/2000 Hoy et al.
6,263,624 B1 7/2001 Hoy et al.

(Continued)

*Primary Examiner* — Robert Canfield
(74) *Attorney, Agent, or Firm* — McKay & Associates, P.C.

(57) ABSTRACT

A large-area skylight system adapted to be located within a field of roofing sheets. A cross member stiffened at two extremities is secured perpendicularly across a curb. A base frame is configured to rest over the curb. A cap frame is disposed over the base frame. A glazing material is then adapted to be secured between the base frame and the cap frame over the cross member along an entire length of the base frame and the cap frame to form an entire length and width of the skylight as a single panel. To ease installation, a downward leg forms a fulcrum at a contact point between the base frame and the cap frame, and to help exhaust water from the system, a dam is disposed within the base frame uphill from each joint, and a weep hole is defined within the base frame uphill of the dam.

19 Claims, 3 Drawing Sheets

U.S. PATENT DOCUMENTS 6,966,157 B1 11/2005 Sandow
7,065,928 B1 * 6/2006 Lane et al. ..... 52/200
7,308,777 B2 12/2007 Sandow
2010/0269426 A1 * 10/2010 Richter et al. ..... 52/171.3

* cited by examiner

LARGE-AREA SKYLIGHT SYSTEM

CROSS-REFERENCE TO RELATED APPLICATIONS

The instant application claims benefit of provisional application Ser. No. 61/467,536 filed Mar. 25, 2011, the disclosure of which is incorporated herein by reference.

BACKGROUND

Skylights placed on sloped roofs have a tendency to be leak-prone. Further, the costs are high when it becomes necessary to alter the roof sheets to accommodate the skylights, and there is an ongoing need to address loads imposed by heavy snow loads or personnel. These problems are exacerbated as the skylights increase in size and comprise a large portion of the roof.

Skylights are composed typically of four metal curbs around its perimeter. The curbs are typically made of sheet steel in the range of 14 gage thickness or aluminum in the range of 0.125" thickness and are insulated by fiberglass batts or isocyanurate blocks. The longitudinal skylight curbs are made in sections which are screwed or bolted together so as to make long vertical curbs. The width-wise distance between curbs is specifically set so that metal roof panels which comprise the main roof will allow the skylight curbs to occupy the area which would have been occupied by one or two or three metal roof sheets. By making these curbs to a specified width, the roof sheets immediately below the skylight can be assembled in the normal fashion and will join each other in their normal seaming method. Typically, the skylights are placed with one end at the ridge of the building, thereby eliminating the need for crickets or saddles. Backseams formed by crickets or saddles have been one source of leakage in many skylights in the past.

Seams and the resulting leakage have been a source of problems for skylight systems. As the size of the skylight increases so too must the framing and thus the number of joints and scams, especially within standing seam roofs which comprise upright legs and thus form even more seams at the skylight framing. The rooting industry seldom uses skylights within standing seam roofs, mainly because the standing scams direct water flow downward resulting in water being directed into the frame. Because of this, skylights in the past have typically been installed as a large number of small units. However, it is difficult to put "crickets" in a standing seam roof because you are required to navigate around the standing scams. If the standing seams are cut in the process it may weaken the structural strength of the panel.

There is a need then for a skylight system which maintains the aesthetics of being wide and narrow so as to occupy a large-area as a single panel but which eliminates the potential for leakage, especially within sloped, standing seam roots.

SUMMARY

The present invention comprehends a large-area skylight system which includes a very long skylight which, due to its length, delivers natural lighting from the center of a building to the eaves. To accommodate such a skylight, a framing system is provided which eliminates horizontal joints, cases installation, eliminates leakage water, can handle a load, and which can seat panels of varying thickness.

Accordingly, provided is a large-area skylight system comprising a curb forming a perimeter of a skylight adapted to be located within a field of roofing sheets. A cross member has an upper flange and a lower extremity, the cross member coped so as to allow the flange to rest on and be secured to the curb perpendicularly across the curb using a fastener, the lower extremity abutting a side of the curb and having defined therein a screw boss for accepting a screw, wherein the cross member is stiffened at the curb such that the skylight can handle a load. A base frame has an inside edge and an outside edge, the base frame configured to rest on the flange over the curb. Next, a cap frame having an interior side and exterior side is disposed over the base frame. A glazing material is then adapted to be secured between the base frame and the cap frame over the cross member along an entire length of the base frame and the cap frame to form an entire length and width of the skylight as a single panel.

To ease installation, the base frame has a side-defined channel cavity, and the cap frame has a downward leg formed integrally along its exterior side and angled therefrom for removable placement within the channel cavity, wherein the leg forms a fulcrum at a contact point between the base frame and the cap frame.

To accommodate a panel of variable thickness, the base frame has a lower channel cavity defined below the upper channel cavity to accommodate the downward leg when the glazing material is of lesser thickness.

Finally, to help exhaust water from the system, because a joint is formed when at least two base frames are joined, a dam is disposed within the base frame uphill from each joint, and a weep hole is defined within the base frame uphill of the dam, wherein water flowing into the base frame is stopped by the dam and exhausted through the weep hole prior to the water reaching the joint. These and other critical features are real zed by the instant invention as follows.

DETAILED DESCRIPTION OF THE PREFERRED EMBODIMENT

The invention will now be described in detail in relation to a preferred embodiment and implementation thereof which is exemplary in nature and descriptively specific as disclosed. As is customary, it will be understood that no limitation of the scope of the invention is thereby intended. The invention encompasses such alterations and further modifications of the principles of the invention illustrated herein, as would normally occur to persons skilled in the art to which the invention relates. This detailed description of this invention is not meant to limit the invention, but is meant to provide a detailed disclosure of the best mode of practicing the invention.

Figure 1:
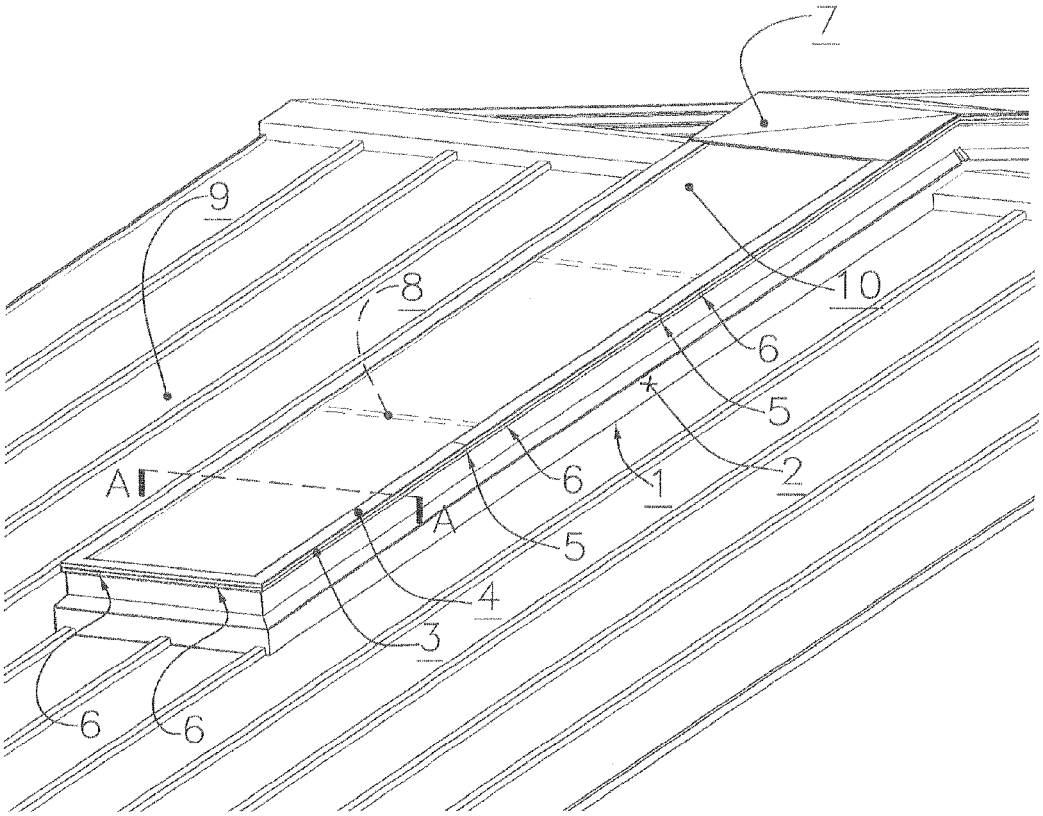
FIG. 1 shows a perspective view of the skylight in accordance with the instant invention as installed within a standing seam roof.
Figure 2:
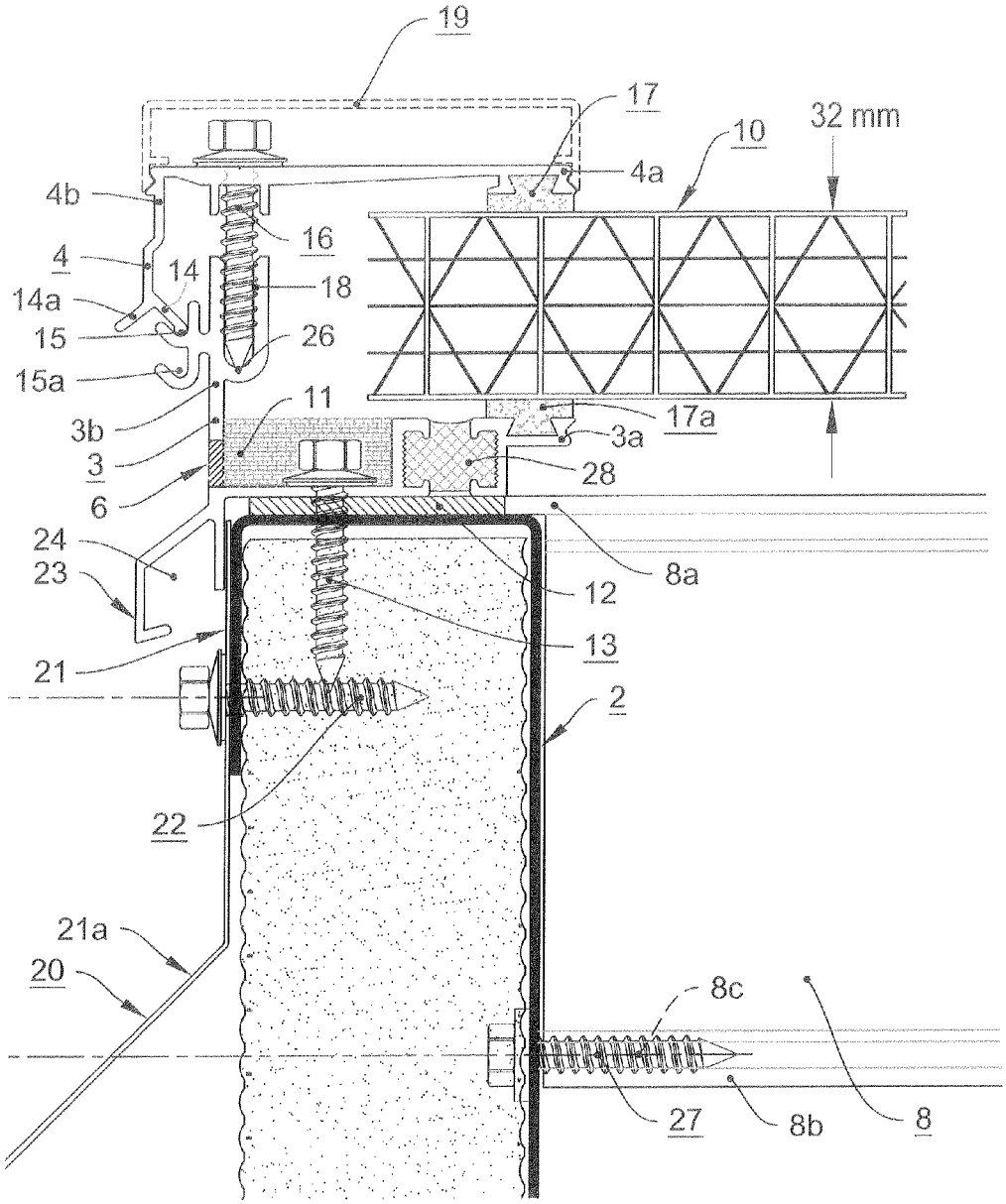
FIG. 2 shows a cross-sectional view of the skylight system as viewed through the plane A-A of FIG. 1.

With reference then to FIGS. 1-2, a skylight curb 2, which is to be further described, forms the perimeter of a skylight 1 which is located within the field of metal roofing sheets 9 as is known in the art, the sheets typically being formed of steel or aluminum and having ribs or corrugations running in the direction of the roof slope. The curb 2 is composed of a metal curb frame, typically made of steel or aluminum in thicknesses from 0.080 to 0.125 inches for example. If a skylight 1 as herein described is placed near the ridge of a roof, it is typically terminated at the ridge via a metal ridge flashing 7 or, alternatively, by a roof ventilator (not shown). As will be referenced herein, the number of screws, holes, and other components will vary depending on the overall length of the system framing and the size requirements for the skylight. Accordingly, "a" or "an" as used in the claims and as disclosed means one or more.

Preferred glazing material 10 comprising the skylight panel itself is a plastic translucent or transparent panel such as polycarbonate which combines strength with aesthetically-pleasing qualities. Structural steel or aluminum cross members 8 are located underneath the glazing material 10 on as to provide reinforcement against deflection which would result from positive loading, including loads imposed by snow or personnel. Each cross member 8 has an upper flange 8*a* and a lower extremity 8*b* and is coped to allow the upper flange 8*a* to rest on and be secured to the curb 2 perpendicularly across the curb 2 using a fastener 13, such as a screw, rivet, bolt or the like. Preferably upper flange 8*a* travels the entire width of curb 2 to rest "entirely" on the curb 2. The lower extremity 8*b* therefore abuts a side of the curb 8, and because the lower extremity 8*b* has a screw boss 8*c* defined therein for accepting a screw 27 (screw, rivet, bolt or the like), the cross member 8 is stiffened at the curb 2 such that the skylight 1 can handle the load. The cross members 8 also rigidize the metal curbs 2 and thus the entire system. For instance, the screw 27 passes through curb 2 and into the screw boss 8*c* of extruded aluminum cross member 8. Further, because cross member 8 is coped so as to allow its upper flange 8*a* to lie on top of curb 2, fastener 13 is able to pass through the upper flange 8*a* and thus further secure cross member 8 to the curb 2. This method of fastening at the upper extremity or upper flange 8*a* and lower extremities 8*b* in part creates stiffening to the curbs 2 and creates the ability for cross member 8 to be structurally capable of handling loads which may result from the deflection of the glazing material 10 due to snow loading or to traffic by personnel. In this way, a critical safety factor is achieved.

Resting over of the curb 2 is a base frame 3, typically an aluminum extrusion. "Over" as used in relation to the curb 2 means the base frame 3 is never in contact with the curb 2, only slightly above the curb 2 held off entirely by a combination of spacers 12 and upper flanges 8*a* of cross members 8, as below. Specifically, the base frame 3 has an inside edge 3*a* and an outside edge 3*b* (relative to position of glazing material 10). Defined at said outside edge 3*b* (exterior to the base frame 3) is an upper channel 15 and a lower channel 15*a*, each of which aid in installation depending on the size of the glazing material 10 as will be further described. Base frame 3 is configured to rest on the upper flange 8*a* of the cross member 8 over the curb 2. Fastener 13 is adapted to secure the base frame 3 to the upper flange 8*a* of the cross member 8 while simultaneously securing the upper flange 8*a* to the curb 2. Base frame 3 is also held slightly off curb 2 by a spacer 12 (preferably elastomeric). This spacer 12 allows structural cross member 8 to be coped and have its upper flange 8*a* also rest under base frame 3. Near thermal break 28, a lower gasket 17*a* is situated along the inside edge 3*a* for disposition against the glazing material 10 such that this integral, lower gasket 17*a* supports the glazing material 10 on one side, i.e. its underside.

Base frame 3 is typically installed in pieces from 5 ft. to 12 ft. in length. As a result, joints 5 may form when at least two base frames 3 are joined. The joints 5 between said base frames 3 are vulnerable to leakage if water should run down inside base frame 3 in the area adjacent to the head of fastener 13. This problem is solved by installing a dam 11, typically composed of sealant or an elastomeric foam, the dam being located just uphill of each joint 5 in base frame 3, "uphill" used in relation to sloping roof. Further, a weep hole 6 is defined just uphill of said dam 11. Therefore, if water flows into and along the inside of base frame 3, it will be stopped by dam 11 and exhausted out through weep hole 6. In this way, the joints 5 between framing members 3 are protected.

Next, a cap frame 4 has an interior side 4*a* and an exterior side 4*b* and is disposed over the base frame 3. The cap frame 4, typically an aluminum extrusion, contains the integral, upper gasket 17 which makes contact with the upper surface of the glazing material 10 and secures it against upward loads, as the cap frame 4 is mated to base frame 3. Cap frame 4 has a downward leg 14 which rests within the upper channel 15 of the base frame 3. This contact point becomes a fulcrum whenever cap screw 16 is tightened such that elastomeric gasket 17 located at one end of cap frame 4 is driven downward to contact and hold the glazing material 10. Cap frame 4 also includes an integral, opposing leg 14*a* formed to its exterior side 4*b* and also integral with the downward leg 14, but opposing leg 14*a* angles away from the downward leg 14 so as to shield the upper channel cavity 15.

Glazing material 10 is a plastic translucent or transparent panel such as polycarbonate and which can be installed in one piece traveling the entire length of the skylight 1. Shown in this embodiment, for example only, is glazing material 10 having a thickness of 32 mm. Glazing material 10 is adapted to be secured between the base frame 3 and the cap frame 4 along the entire length of the base frame 3 and cap frame 4 to therefore form an entire length and width of the skylight as a single, large-area panel.

Additionally, and as it relates to installation, the instant large-area skylight system includes flashing 20, which is preferably metal. The flashing 20 has an upper leg 21 and an angular lower leg 21*a* with the upper leg lapping under the base frame 3 and secured to the curb 2 using a flashing screw 22. At the outside of curb 2, the metal flashing 20 is installed to direct water over portions of the roofing materials below. As above, the upper leg 21 may be installed prior to the installation of base framing member 3, thus allowing leg 21 to lap under base frame 3. An alternative configuration will be shown in FIG. 3. As shown in FIG. 2, flashing 20 is secured to the outer flange of curb 2 by flashing screw 22, which can be a screw, rivet, bolt, or other fastening means. An extending leg 23 integrally on base frame 3 extends outward to define a downward cavity 24 and which shelters flashing screw 22 from rainfall.

Base frame 3 further comprises an internal screw track 18 defined proximate to the outside edge 4*b* to accommodate a cap screw 16 (screw, rivet, bolt, fastening means). When cap screw 16 is driven home, its length is such that its point 26 is driven into the bottom of screw track 18. This "bottoming out" of cap screw 16 prevents the screw from being overdriven and thus bending cap frame 4 or, alternatively, causing upper gasket 17 to bear against glazing material 10 with undue compression force, i.e. excessive pressure which could cause breakage or damage. For cosmetic purposes an aluminum cover 19 may be snapped onto cap frame 4 for purposes of hiding the exposed heads of cap screws 16.

Figure 3:
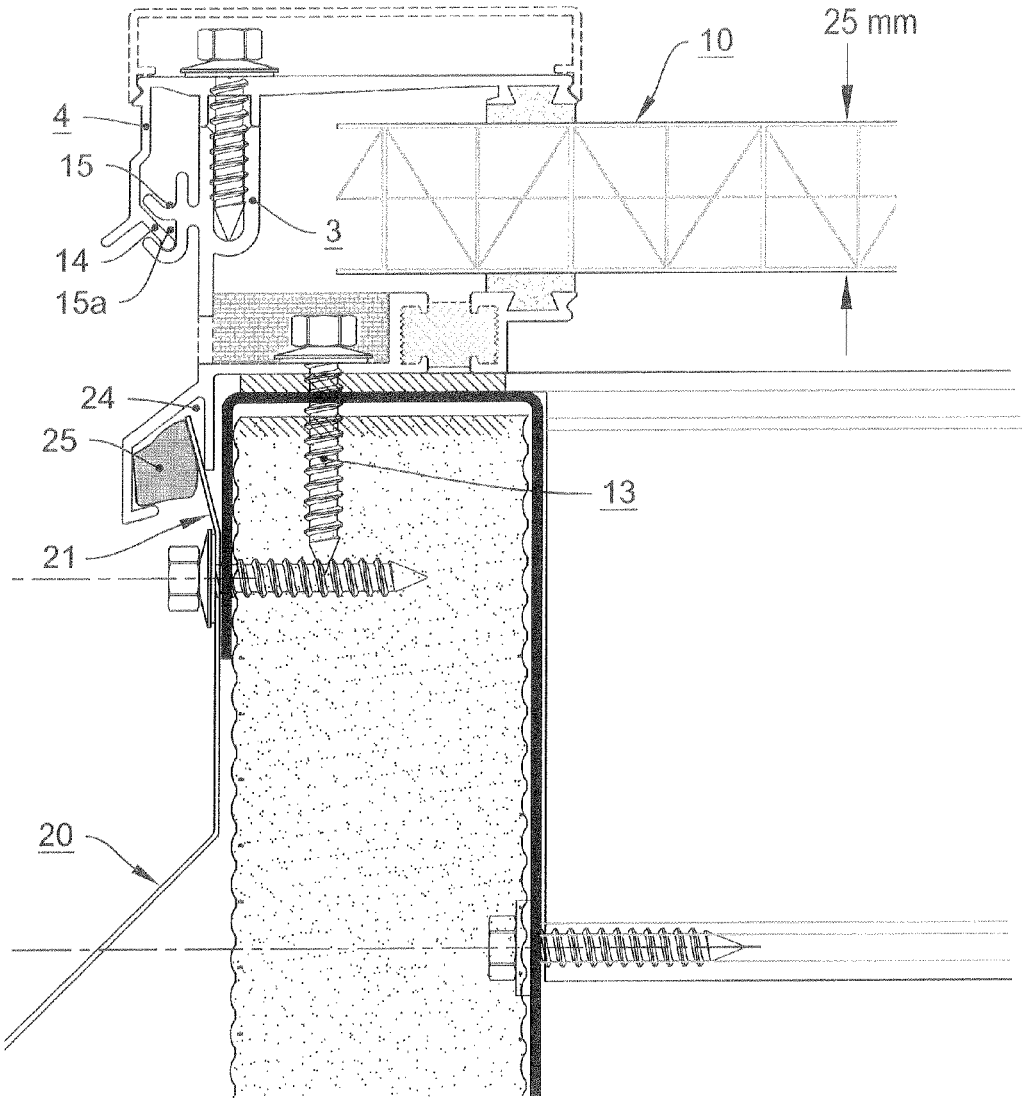
FIG. 3 shows a cross-sectional view of the skylight system in an embodiment in which the glazing material or panel as shown of lesser thickness than the panel shown FIG. 2 and the flashing is in a tucked form.

With reference to FIG. 3, FIG. 3 shows an installation similar to FIG. 2 except glazing material 10, which was shown in FIG. 2 as 32 mm thick, is replaced by glazing material 10 which is 25 mm thick for example. Because of the reduced thickness, downward leg 14 of cap frame 4 is placed in the lower channel 15*a*, thus causing proper alignment for use with this thinner (25 mm) glazing material. Therefore, lower channel 15*a* defined below upper channel 15 now accommodates downward leg 14 of cap frame 4 when glazing material 10 is of lesser thickness, i.e. less than the glazing material thickness more suitable for the installation shown in FIG. 2.

An alternate method for installing flashing 20 is also shown in FIG. 3 wherein the upper leg 21 of the flashing 20 is tucked into the downward cavity 24 of base frame 3 and a continuous elastomeric filler 25 is fitted into the cavity so as to provide a weather seal against flashing upper leg 21. In this way, flashing 20 can (alternatively) be installed after base frame 3 and cap frame 4 have been installed.

We claim:

1. A large-area skylight system, comprising:

a curb forming a perimeter of a skylight adapted to be located within a field of roofing sheets;

a cross member having an upper flange and a lower extremity, said cross member coped to allow said flange to rest on and be secured to said curb perpendicularly across said curb using a fastener, said lower extremity abutting a side of said curb and having defined therein a screw boss for accepting a screw;

a base frame having an inside edge and an outside edge, said base frame configured to rest on said flange over said curb;

a cap frame having an interior side and exterior side and disposed over said base frame; and, glazing material adapted to be secured between said base frame and said cap frame over said cross member along an entire length of said base frame and said cap frame to form an entire length and width of said skylight as a single panel.

2. The large-area skylight system of claim 1, further comprising a spacer abutting said flange of said cross member and situated on said curb holding off said base frame from said curb.

3. The large-area skylight system of claim 1, further comprising a cover for placement over said cap frame.

4. The large-area skylight system of claim 1, wherein said base frame further comprises a lower gasket situated along said inside edge for disposition against said glazing material, and wherein said cap frame further comprises an upper gasket situated along said interior side for disposition against said glazing material.

5. The large-area skylight system of claim 1, wherein a joint is formed when at least two base frames are joined, and wherein said skylight system further comprises a dam disposed within said base frame uphill from each said joint and a weep hole defined within said base frame uphill of said dam for exhausting water before said water can reach said joint.

6. The large-area skylight system of claim 1, further comprising a flashing having an upper leg and angular lower leg, said upper leg lapping under said base frame and secured to said curb using a flashing screw, and an extending leg integral to said base frame defining a base cavity by extending outward from said base frame so as to shelter said flashing screw.

7. The large-area skylight system of claim 6, wherein said upper leg is tucked into said base cavity.

8. The large-area skylight system of claim 7, further comprising a filler disposed within said cavity to provide a weather seal against said upper leg.

9. A large-area skylight system, comprising:

a curb forming a perimeter of a skylight adapted to be located within a field of roofing sheets;

a base frame having an inside edge and an outside edge, said base frame configured to rest over said curb, said base frame having an upper channel defined at said outside edge exterior to said base frame;

a cap frame having an interior side and exterior side and disposed over said base frame, said cap frame having a downward leg formed integrally along said exterior side and angled therefrom for removable placement within said upper channel, wherein said leg forms a fulcrum at a contact point between said base frame and said cap frame;

a screw track defined within said base frame proximate to said outside edge to accommodate a cap screw driven through a hole in said cap frame to thereby removably secure said cap frame to said base frame without undue compression force; and, glazing material adapted to be secured between said base frame and said cap frame along an entire length of said base frame and said cap frame to form an entire length and width of said skylight as a single panel.

10. The large-area skylight system of claim 9, further comprising said base frame having a lower channel defined below said upper channel to accommodate said downward leg when said glazing material is of lesser thickness.

11. The large-area skylight system of claim 10, wherein said exterior side of said cap frame includes an opposing leg formed integral to said exterior side and to said downward leg but angled away from said downward leg so as to shield said lower channel.

12. The large-area skylight system of claim 9, further comprising a cross member having an upper flange, said cross member coped so as to allow said upper flange to rest on and be secured to said curb.

13. The large-area skylight system of claim 12, further comprising a fastener, said fastener adapted to secure said base frame to said upper flange of said cross member while simultaneously securing said upper flange to said curb.

14. The large-area skylight system of claim 12, further comprising a spacer abutting said upper flange of said cross member and situated on said curb holding off said base frame from said curb.

15. The large-area skylight system of claim 9, wherein said base frame further comprises a lower gasket situated along said inside edge for disposition against said glazing material, and wherein said cap frame further comprises an upper gasket situated along said interior side for disposition against said glazing material.

16. The large-area skylight system of claim 9, further comprising a flashing having an upper leg and angular lower leg, said upper leg lapping under said base frame and secured to said curb using a flashing screw, and an extending leg integral to said base frame defining a base cavity by extending outward from said base frame so as to shelter said flashing screw.

17. The large-area skylight system of claim 16, wherein said upper leg is tucked into said base cavity.

18. The large-area skylight system of claim 16, further comprising a filler disposed within said cavity to provide a weather seal against said extending leg.

19. A large-area skylight system, comprising:

a curb forming a perimeter of a skylight adapted to be located within a field of roofing sheets;

a base frame configured to rest over said curb, wherein a joint is formed when at least two base frames are joined;

a dam disposed within said base frame uphill from each said joint;

a weep hole defined within said base frame uphill of said dam, wherein water flowing into said base frame is stopped by dam and exhausted through said weep hole prior to said water reaching said joint;

a cap frame disposed over said base frame, and, glazing material adapted to be secured between said base frame and said cap frame along an entire length of said base frame and said cap frame to form an entire length and width of said skylight as a single panel.

* * * * *